United States Patent [19]

Houle

[11] 4,439,877

[45] Apr. 3, 1984

[54] SHOWER ARRANGEMENT FOR BATHING UNITS

[75] Inventor: Raymond T. Houle, Traverse, Mich.

[73] Assignee: Silchor, Traverse, Mich.

[21] Appl. No.: 362,485

[22] Filed: Mar. 26, 1982

[51] Int. Cl.[3] ..... A47K 3/22

[52] U.S. Cl. ..... 4/596; 4/568; 4/555; 4/557; 4/604

[58] Field of Search ..... 4/569, 552, 596, 567, 4/568, 555, 556, 557, 604, 601, 615

[56] References Cited

U.S. PATENT DOCUMENTS

| | | | |
|---|---|---|---|
| 1,339,593 | 5/1920 | Booth | 4/568 |
| 1,677,160 | 7/1928 | Woolfenden | 4/568 |
| 2,166,469 | 7/1939 | Houston | 4/569 |
| 3,380,078 | 4/1968 | Hanson | 4/555 |
| 3,562,821 | 2/1971 | Queen | 4/604 |
| 4,010,498 | 3/1977 | Jablonski | 4/569 |
| 4,099,272 | 7/1978 | Sowder | 4/555 |
| 4,118,810 | 10/1978 | Brickhouse et al. | 4/567 X |

OTHER PUBLICATIONS

"Fulljet Nozzles" and Floodjet Nozzles by Spraying Systems Company (publication data unknown).

*Primary Examiner*—Henry K. Artis

*Attorney, Agent, or Firm*—Price, Heneveld, Huizenga & Cooper

[57] ABSTRACT

An improved shower arrangement is provided for invalid bathing units and the like, such as those comprising a sit-down bathtub having a lateral opening in one side to permit ingress and egress therethrough, and a vertically slidable door to selectively open and close the bathtub opening. The shower arrangement includes a plurality of fine-spray, wide-angle nozzles mounted along the left and right-hand sides of the bathtub, which collectively produce a gentle, blanket-like mist that completely covers the front of the bather. Preferably, a separate, fan-spray nozzle is mounted on the rear wall of the bathtub, and flows a thin sheet or film of water therealong, which cushions and baths the back and bottom of the seated invalid. Pressurized water is supplied to the spray nozzle located in the door by two mating fittings, which are mounted on the bathtub and the door respectively, such that when the door is closed, the fittings are converged into sealing abutment to communicate a source of pressurized water with a supply manifold for the nozzles.

33 Claims, 3 Drawing Figures

SHOWER ARRANGEMENT FOR BATHING UNITS

CROSS-REFERENCE TO RELATED APPLICATIONS

The present application is related to co-pending U.S. patent applications Ser. No. 187,522, filed Sept. 15, 1980, now U.S. Pat. No. 4,346,485, entitled APPARATUS AND METHOD FOR BATHING INVALIDS, and Ser. No. 362,484, filed Mar. 26, 1982, entitled MANUAL IN-DOOR LOCK ARRANGEMENT FOR BATHING UNITS, now U.S. Pat. No. 4,399,569, which are hereby incorporated by reference.

BACKGROUND OF THE INVENTION

The present invention relates to bathing units, and in particular, to an improved shower arrangement therefor.

A novel bathing apparatus for invalids and others with impaired ambulatory ability is disclosed in my above referenced co-pending U.S. patent application Ser. No. 187,522, now U.S. Pat. No. 4,346,485. This bathing apparatus comprises a bathtub with upstanding walls that form a stall. The bathtub includes a seat having an anatomical contour, and a lateral opening adjacent the seat to permit invalid ingress and egress. A door with a generally wedge-shaped contour mates with and selectively closes the bathtub opening. A seal is compressed between the opening and the door to form a seal which is sufficiently watertight to permit immersal bathing of a seated invalid. The door is slidably mounted on a hingeless track assembly, which permits vertical translation of the door into a closed position, and pivots the door as it is raised into a horizontal, overhead storage position. The bathtub seat and opening are mutually oriented so as to permit an attendant to laterally move the invalid from a wheelchair directly onto the bathtub seat with minimum strain and hazzard.

The above-described bathing unit has two shower heads located at the opposite ends of the bathtub. One shower head is mounted centrally in the forward wall of the bathtub, at a location directly below the spigot and overflow drain valve. This shower head is aimed toward the rear of the bathtub, and discharges a scattered jet or stream of water directly at the forward side of the bather. Since the spray is emitted from the forward wall of the bathtub, at an elevation slightly above the waist of the bather, it has a relatively flat trajectory, so that it will cover the chest of the bather, as well as his mid-seciton and legs.

The second shower head in the above-described bathing apparatus is positioned centrally in the rear enclosure wall, at a location slightly above the rear rim of the bathtub. This shower head is aimed toward the front of the bathtub, and discharges a scattered stream of water onto the shoulders and back of the bather.

Both the forward and rearward shower heads described above have a relatively high flow rate, so that they will achieve complete coverage over the seated bather. However, it has been determined that this type of shower spray pattern is sometimes considered somewhat uncomfortable or intimidating to the bather, particularly with resepct to those bathers who are quite infirm or unsteady. Also, the flat trajectory of these spray patterns creates a shower spray which is not very gentle or soft.

SUMMARY OF THE INVENTION

One aspect of the present invention is an improved shower arrangement for bathing units, comprising a plurality of fine-spray, wide-angle nozzles mounted along the left and right-hand sides of the bathtub, which collectively create a very gentle, blanket-like mist that completely covers the front of the bather. The mounting of the spray nozzles along the sides of the bathtub, instead of the front and rear walls of the bathtub, greatly alleviates intimidation of the patient and associated anxiety. Further, the multiple nozzle arrangement achieves full coverage of the bather with a very gentle or soft mist, instead of conventional shower heads which have a somewhat harsh or hard spray. The efficiency achieved by the fine spray pattern reduces the amount of water required for showering.

Another aspect of the present invention is a mechanism to supply pressurized water to the spray nozzles mounted in the door of the bathing unit. This mechanism comprises a pair of mating fittings that align when the door is closed, and converge to form a seal between a supply line for pressurized water and a manifold line for the door mounted nozzles. When bathing is concluded, the fittings are diverged and the door is raised into its overhead storage position, such that the supply of water to the nozzles is disrupted and prevents leakage. In one embodiment of the present invention, one of the fittings is automatically reciprocated into and out of engagement with the mating fitting by manipulation of the locking lever for the door.

In another embodiment of the present invention, the fittings are mounted on mating portions of the lower edge of the door and the bathtub lip, whereby when the door is closed the fittings are automatically converged into an abutting, sealing relationship.

The principal objects of the present invention are to provide an improved shower arrangement for bathing units, wherein a very gentle, blanket-like mist is emitted from both the left and right-hand sides of the bathtub to completely cover the bather. A fan-shaped spray forms a cushioning film along the back and bottom of the bather for improved comfort, cleansing and therapeutic effect. Specially designed plumbing fittings reliably supply pressurized water to nozzles mounted in the door, and prevent inadvertent leakage when the door is stored in its overhead position. The shower arrangement is quite efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
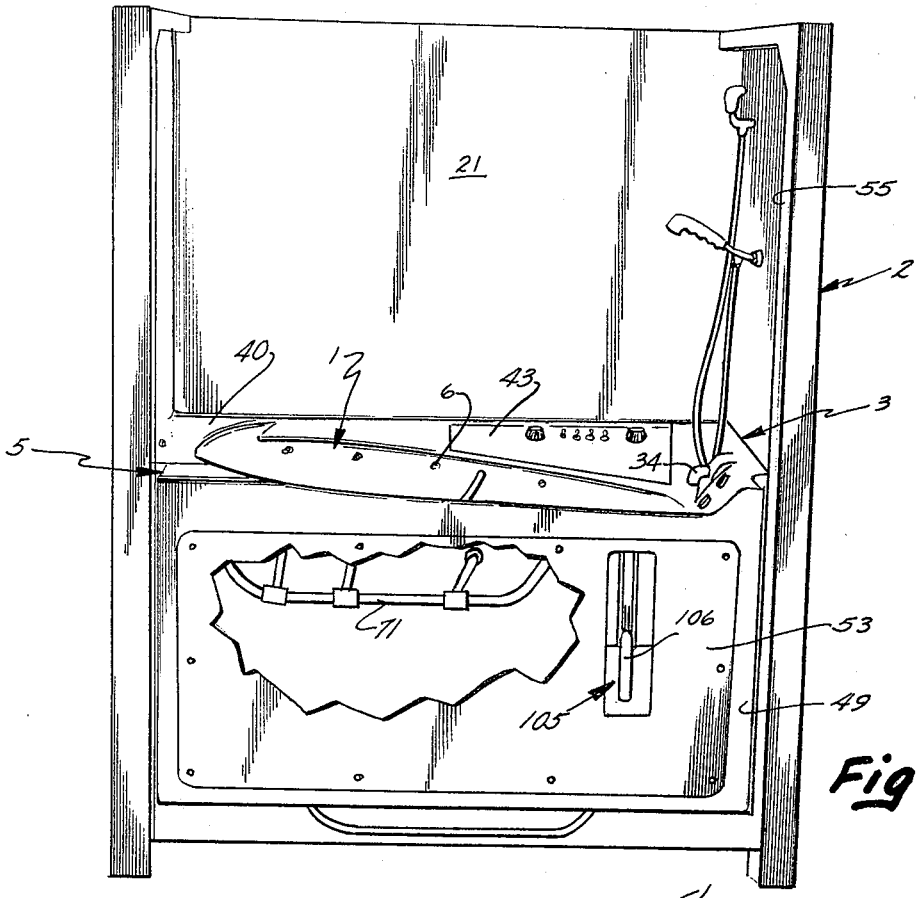
FIG. 1 is a front perspective view of a bathing apparatus having a shower arrangement embodying the present invention, with a portion of the bathing apparatus broken away to reveal internal construction.
Figure 9:
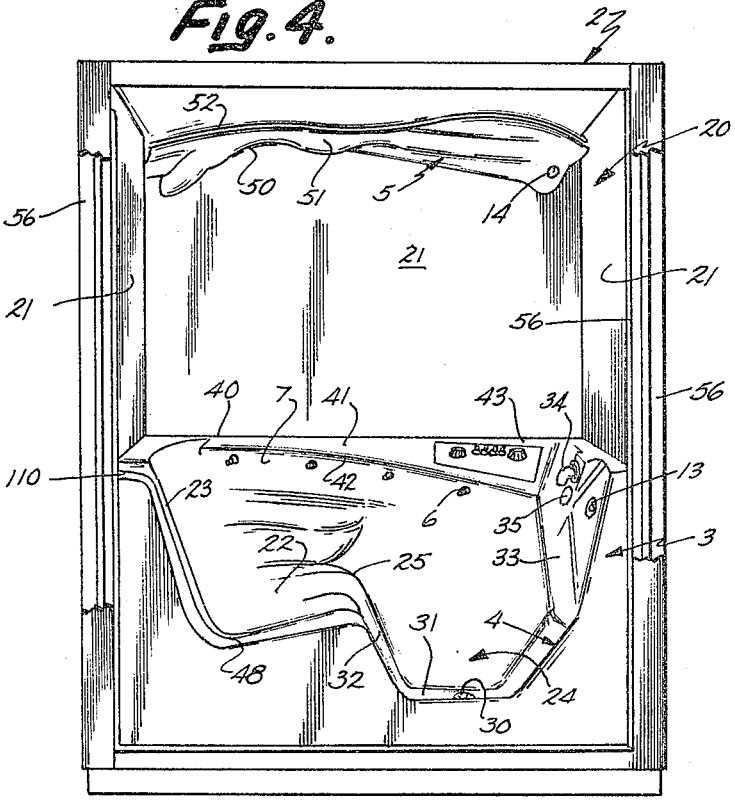
FIG. 9 is a front perspective view of the bathing apparatus, with the door shown in an overhead storage position, and particularly illustrating mating plumbing fittings to communicate pressurized water to the side nozzles mounted in the door.

For purposes of description herein, the terms "upper," "lower," "right," "left," "rear," "front," "vertical," " horizontal" and derivitives thereof shall relate to a seated bather as oriented in FIGS. 1 and 9. However, it is to be understood that the invention may assume various alternative orientations, except where expressly specified to the contrary.

Figure 2:
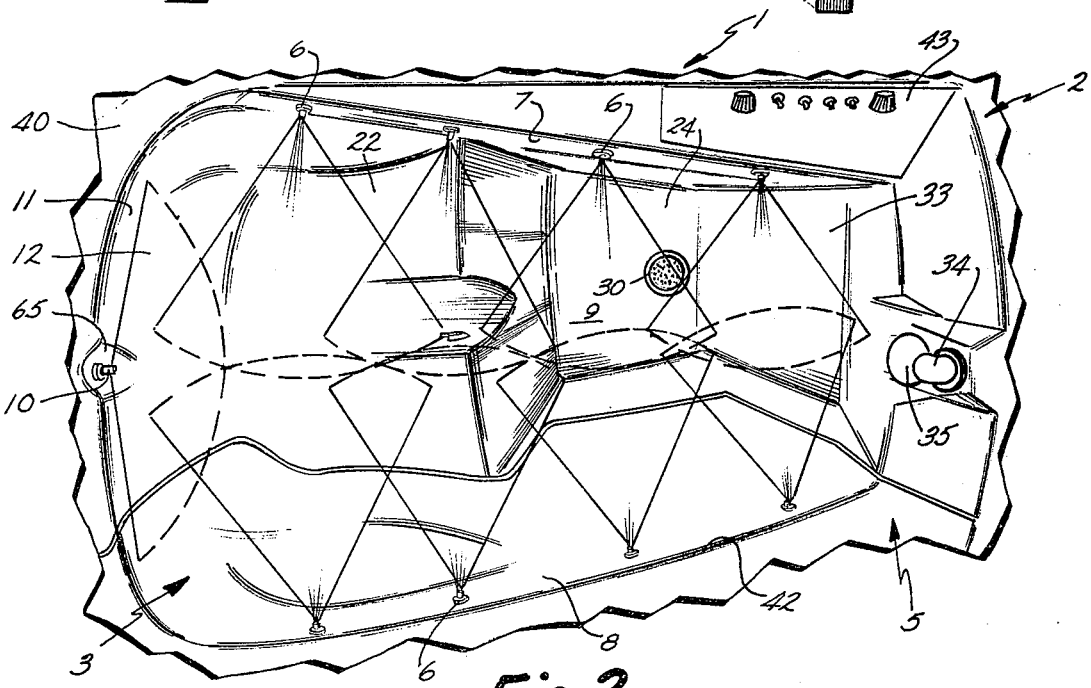
FIG. 2 is a fragmentary, top perspective view of the bathing apparatus, particularly showing a blanket-like mist produced by the shower arrangement.
Figure 3:
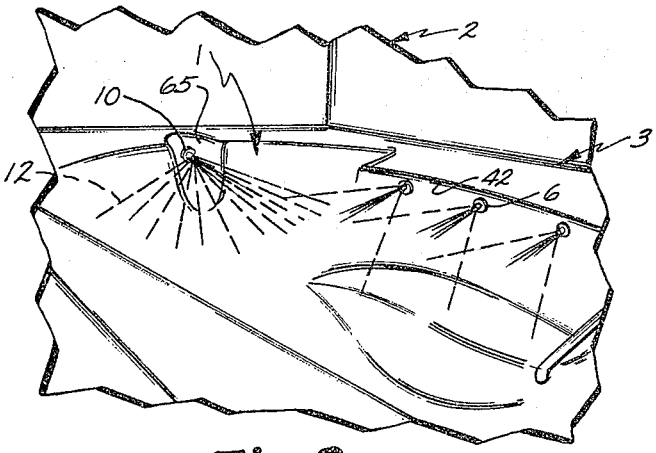
FIG. 3 is a fragmentary, perspective view of a rear portion of the bathing apparatus.

The reference numeral 1 (FIG. 2) generally designates an improved shower arrangement for invalid bathing units, such as the illustrated bathing apparatus 2. Bathing unit 2 comprises a bathtub 3 (FIG. 9) having a lateral opening 4 in one side thereof to permit ingress and egress. A vertically slidable door 5 selectively opens and closes bathtub opening 4. Shower arrangement 1 (FIG. 2) includes a plurality of fine-spray, wide-angle nozzles 6 mounted along the left and right-hand sides 7 and 8 respectively of bathtub 3, which collectively create a gentle, blanket-like mist 9 that completely covers the front of a seated bather. A separate, fan-spray nozzle 10 is mounted on the rear wall 11 of bathtub 3, and flows a thin sheet or curtain 12 of water therealong to bathe the back and bottom of the seated invalid. Pressurized water is supplied to those spray nozzles 6 mounted in door 5 by two mating fittings 13 and 14 (FIGS. 10–11), which are mounted on bathtub 3 and door 5 respectively, so that when door 5 is closed, as shown in FIG. 1, fittings 12 and 13 are aligned and converge into sealing abutment to communicate a source of pressurized water with the nozzles 6 mounted in door 5.

Aside from the improved shower arrangement 1 disclosed in greater detail hereinafter, bathing unit 2 is substantially identical with the apparatus disclosed in my above-referenced, co-pending United States patent application Ser. No. 187,522. Although shower arrangement 1 is described herein in conjunction with bathing unit 2, it is to be understood that the novel concepts disclosed may also be used in other applications.

Figure 4:
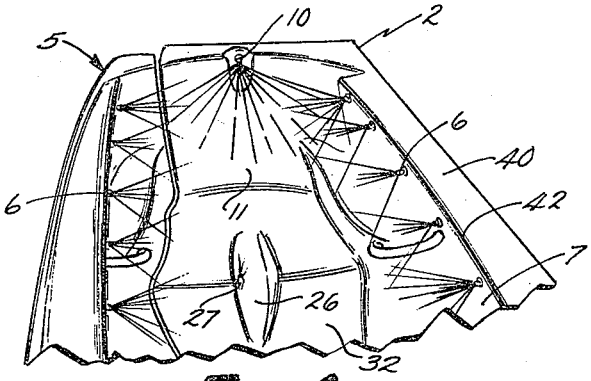
FIG. 4 is a fragmentary, perspective view of a bathtub portion of the bathing apparatus, taken from an angle different from that in FIG. 3.

In the illustrated example (FIG. 9), bathing unit 2 includes an enclosure 20, having three upstanding walls 21 along the left-hand side and ends of bathtub 3 to form a shower stall. Bathtub 3 comprises a seat 22, a back 23, and a footwell 24, which are integrally molded in one piece from a durable, rigid, non-corrosive material, such as fiberglass or the like. Seat 22 is disposed at an elevation substantially coextensive with that of a conventional wheelchair, and is inclined slightly to the rear. The forward edge 25 of seat 22 is rounded, and the rearward edges are arcuately shaped and blend smoothly with back 23. Back 23 is angled slightly rearwardly, so that the bather is seated in a slightly reclined position in bathing unit 2. A cup or trough 26 (FIG. 4) is provided in the middle of seat 22 to expose the perineal area of a seated bather, and includes a spray nozzle 27 for sitz bathing. In this example, nozzle 27 is identical with side nozzles 6, and is mounted in the right-hand sidewall of trough 26.

Footwell 24 is disposed below and forward of seat 22, and comprises a shallow reservoir with a drain 30 mounted therein. Footwell 24 tapers inwardly toward the front of bathtub 3, and includes a base 31, an incline kickwall 32, and a front panel 33 in which a spout 34 and overflow drain 35 are mounted.

The upper edges of the bathtub walls define a rim 40. In this example, rim 40 includes a downwardly inclined upper surface 41 which blends into the sidewalls along a rounded edge 42. Controls 43 are mounted on rim surface 41 at the forward, left-hand side of bathtub 3. Controls 43 vary the temperature and flow of water into the bathing unit, and preferably include means to independently select water flow through the groups of nozzles 6 on the left and right-hand sides of bathtub 3.

Bathtub opening 4 has a generally wedge-shaped, upwardly opening contour defined by a lip 48, which extends generally along the right-hand side of bathtub seat 22 to facilitate invalid ingress and egress. Door 5 has a substantially planar exterior side 49, and an interior side 50 with a portion of the tub interior molded integrally therewith to mate with the contour of the stationary tub half when the two halves are converged vertically. The contoured interior 50 of door 5 includes a wedge-shaped ledge 51 which mates with lip 48. A compression seal 52 is attached to the lower surface of door ledge 51 and is compressed against bathtub lip 48 when door 5 is closed to form a substantially watertight seal therebetween for immersal bathing. As best illustrated in FIG. 1, door 5 has a hollow two-wall construction, with an open interior cavity. The exterior side 49 of door 5 includes an opening with a removable closure panel 52 covering the same to access the interior of door 5 for assembly and maintenance.

Figure 7:
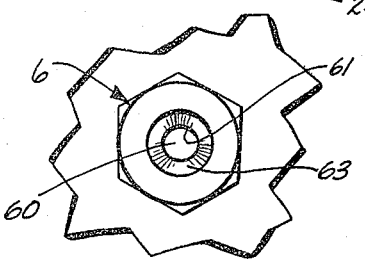
FIG. 7 is a front elevational view of a side nozzle, having a cone-shaped spray.

Door 5 is supported on hingeless track assembly 55, which guides the door vertically into the closed position shown in FIG. 1, and pivots the door as it is raised into the horizontal, overhead storage position shown in FIG. 7. In this example, rails 56 are attached to the sidewalls 21 of enclosure 20, and have a generally inverted L-shape. Rollers (not shown) slidably mount the sides of door 5 within rails 56.

Figure 8:
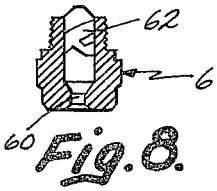
FIG. 8 is a cross-sectional view of the side nozzle, schematically illustrating the cone-shaped spray emitted therefrom.

A plurality of side spray nozzles 6 are mounted in both the left and right-hand sides of bathtub 3 at a location slightly below the edge 42 of bathtub rim 40. Nozzles 6 are spaced generally evenly along rim 40, and are oriented generally downwardly toward the seat 22 and footwell 24 of bathtub 3. Preferably, spray nozzles 6 (FIGS. 7 and 8) have an orifice 60 shaped to emit a wide angle, cone-shaped spray pattern with uniform distribution. The throat portion 61 of orifice 60 is relatively small, in the nature of 5/64 inches, such that the spray emitted is in the nature of a very fine mist, having a flow rate of between 0.9 and 1.3 gallons per minute at a pressure in the range of 40–80 psi. A dispersing wedge or vane 62 is mounted within the body of nozzle 6, and helps break up the onrushing stream of water into droplets that create a fine mist. The frustoconical portion 63 of orifice 60 produces a full conical spray pattern with an angle of between 52 and 59 degrees. The range of the spray pattern is preferably slightly greater than one-half the width of bathtub 3, such that adjacent spray patterns overlap both at the forward fronts and the sides. One example of a suitable side nozzle 6 is known as a Fulljet 1/8665 303 Stainless Steel, by Spraying Systems Company.

Figure 5:
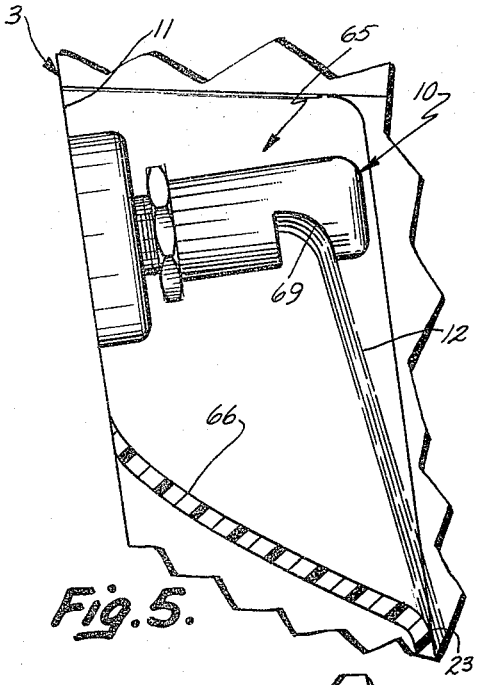
FIG. 5 is an enlarged, fragmentary, vertical cross-sectional view of a rear wall of said bathtub, particularly showing a rear nozzle having a fan-shaped spray.
Figure 6:
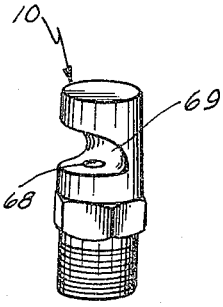
FIG. 6 is a perspective view of the rear nozzle.

The rear spray nozzle 10 (FIGS. 5 and 6) is mounted in a concave depression or cup 65 in the rear wall 11 of bathtub 3. Cup 65 has a depth which is sufficiently large to fully recess nozzle 10 therein, so as to prevent contact with the back or neck of a reclining bather. The bottom wall 66 of cup 65 tapers gently outwardly to the seat back 23. Nozzle 10 has a flat, or fan-shaped spray pattern, which is oriented generally downwardly and outwardly from cup 65, to flow a thin film or layer 12 of water along the back wall 23 of bathtub 3 to bath the back and bottom portions of the seated invalid. The spray emitted from nozzle 10 is in the nature of a low impact, cushioning film of water which not only bathes the invalid, but also imparts comfort to the back and seat, and has therapeutic effect. The illustrated nozzle 10 is a wide, deflector-type nozzle, comprising a central, axially extending, circular orifice 68, and an arcuate deflection surface 69. In this example, nozzle 10 has a flow rate in the range of 3.1 to 4.4 gallons per minute at a pressure of between 30 and 60 psi, and a spray angle of between 106 and 131 degrees. One example of a suitable rear nozzle 10 is known in the trade as a floodjet ⅛ K18 303 Stainless Steel, by Spraying Systems Company.

In the examples illustrated herein, the left-hand side 7 and right-hand side 8 of bathtub 3 each includes four side nozzles 6 mounted therein, and positioned in a regularly spaced apart fashion just below the edge 42 of bathtub rim 40. The nozzles 6 are generally laterally aligned in pairs, and the spray patterns of the nozzles overlap thereby creating a very soft or gentle, blanket-like mist that completely covers the interior of the bathtub, and hence the front of an invalid seated therein.

The nozzles 6 mounted in the right-hand side 8 of bathtub 3 are disposed in door 5. Since door 5 is translated on hingeless track assembly 55 between the closed position shown in FIG. 1, and the overhead storage position shown in FIG. 7, a special mechanism is provided to supply water to the door mounted nozzles. A header or manifold 71 is disposed within the interior of door 5, and distributes pressurized water to each of the nozzles 6 mounted in door 5.

Figure 10:
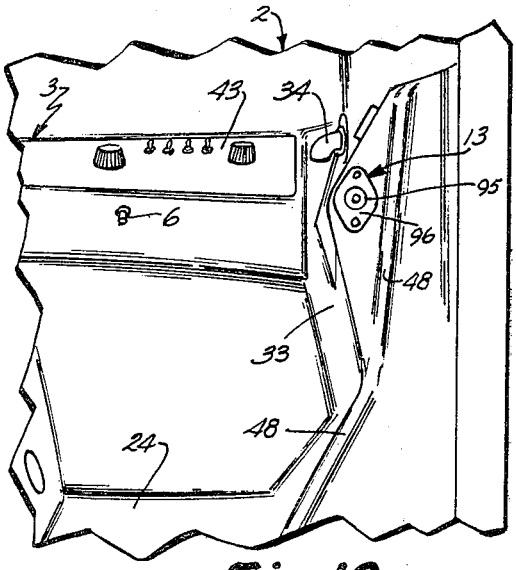
FIG. 10 is a fragmentary, perspective view of the bathing apparatus, illustrating a stationary one of the plumbing fittings mounted in the bathtub.
Figure 11:
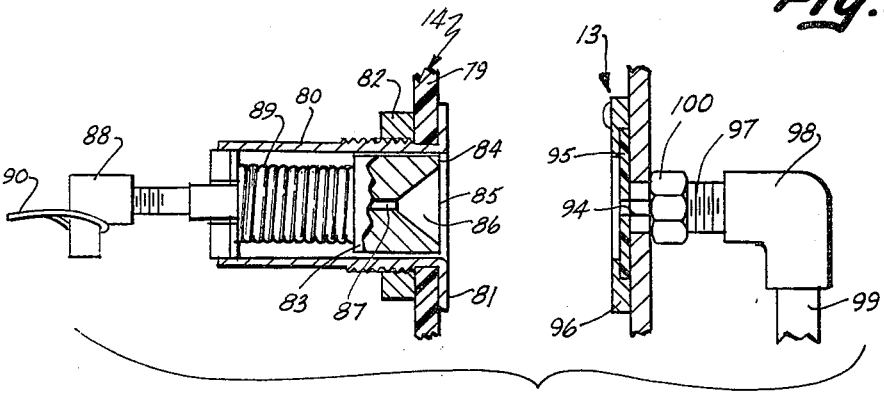
FIG. 11 is a cross-sectional view of the mating plumbing fittings.

With reference to FIGS. 10–11, fittings 13 and 14 are mounted on bathtub 3 and door 5 respectively, and are positioned to converge into an aligned relationship when door 5 is closed. In the illustrated example of FIGS. 10–11, fitting 13 is mounted in the upper, right-hand side of front panel 33, adjacent lip 48, and is oriented along a generally horizontal axis. Fitting 14 is mounted in a corresponding interior portion of door 5 (FIG. 9), and as best shown in FIG. 11, comprises a hollow cylindrical housing 80 which is received through a mating aperture in the interior sidewall 79 of door 5, and includes an exterior flange 81. The exterior surface of housing 80 is threaded, and a nut 82 is mounted on the threaded portion of housing 80 to securely lock the housing in door 5. A plunger 83 is slidingly and telescopingly received within the interior of housing 80, and is adapted for reciprocation therein. Plunger 83 includes a rim 84 at the outer free end 85 thereof, and a conical aperture 86, which communicates with a longitudinal aperture 87 extending through the longitudinal axis of plunger 83. A fitting 88 connects the inlet end of the nozzle manifold 71 with plunger passageway 87. The inner end of plunger 83 includes a shoulder against which a coil spring 89 abuts to resiliently urge plunger 83 outwardly. A cable 90 is attached to fitting 88, and is adapted to reciprocate plunger 83 within housing 80, as described in greater detail hereinafter. When plunger 83 is fully extended, rim 84 protrudes from flange 81 into engagement with fitting 13. When plunger 83 is fully retracted, rim 84 is recessed inwardly of flange 81 to permit the unobstructed translation of door 5.

Mating fitting 13 is positioned on bathtub 3 in horizontal alignment with fitting 12 when door 5 is fully closed. Fitting 13 includes a resiliently compressible pad 95, which is supported on the outer surface of bathtub 3 by a bracket 96. Compression pad 95 includes a central orifice 94 therethrough, which communicates through a nipple 97 and fitting 98 to a supply line 99 for pressurized water. A nut 100 retains fitting 13 securely in place in door 3.

Door 5 includes a locking mechanism 105 (FIG. 1) which is described in detail in my co-pending U.S. patent application Ser. No. 362,484, filed Mar. 26, 1982 entitled MANUAL IN-DOOR LOCK ARRANGEMENT FOR BATHING UNITS. Locking mechanism 105 includes an arm 106, which is pivoted up and down in a substantially vertical plane between locked and unlocked positions. Preferably, cable 90 connects locking arm 106 with plunger 83, and retracts plunger 83 when door 5 is unlocked, and releases plunger 83 when door 5 is locked. Hence, when door 5 is unlocked, plunger 83 is recessed within housing 80 to protect rim 84, and avoid obstructing the bathtub as door 5 is raised and lowered. When door 5 is closed and locked, the tension on cable 107 is released, such that the resilient force of spring 89 resiliently urges the rim 84 of plunger 83 into sealing abutment against pad 95. Water from supply line 99 is thus communicated through fittings 12 and 13 into the door nozzle manifold 71 only when door 5 is fully closed and locked.

Another embodiment of the plumbing arrangement for the door mounted nozzles 6 is illustrated in FIGS. 10 and 11. Since this embodiment is similar to the structure illustrated in FIGS. 12 and 13, and described hereinabove, similar parts appearing in FIGS. 10–11 and FIGS. 12–13 will be designated by the same reference numerals, except for the suffix "a" in the numerals letters.

Figure 13:
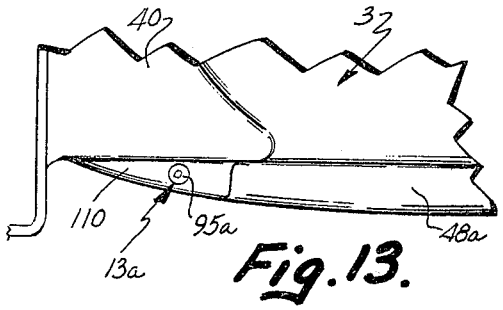
FIG. 13 is a fragmentary, top plan view of a rear, left-hand corner of the bathtub, and particularly showing a stationary one of the plumbing fittings shown in FIG. 12.
Figure 12:
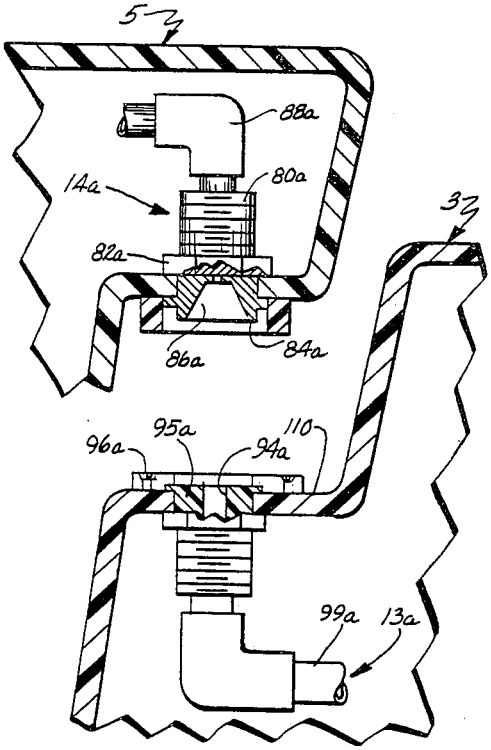
FIG. 12 is a fragmentary, cross-sectional view of an alternate set of mating plumbing fittings, shown in an aligned, slightly separated condition.

In the embodiment illustrated in FIGS. 12 and 13, fitting **13*a* is mounted in a ledge 110 (FIG. 9) at upper, right-hand side of bathtub lip 48, adjacent lip 48. Fitting 13*a* is oriented generally vertically, and supply line 99*a* is connected with a source of pressurized water. Fitting 14*a* is mounted in the ledge 51 of door 5, and is vertically aligned with fitting 13*a* when door 5** is closed.

Fitting 14a (FIGS. 12 and 13) has a one-piece integral construction, instead of the two-piece sliding plunger 83 and housing 80 shown in FIGS. 10–11. The rim 84 of a fitting 14a (FIG. 11) extends into a mating aperture in seal 52. When door 5 is closed, rim 84a is automatically converged into sealing abutment with pad 95a.

In the embodiment illustrated in FIGS. 12 and 13, compression fittings 13a and 14a may be replaced by a mating male and female plumbing couple (not shown), comprising a spring loaded plunger connected with door 5, with an O-ring adjacent the free end thereof, and a longitudinally resilient socket connected with tub ledge 110, and shaped to closely receive the plunger therein, in the nature of a quick disconnect arrangement.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A bathing apparatus, comprising:

a bathtub having opposite side and end walls, a raised seat portion, a back portion, and a foot portion; said seat, back and foot portions having an anatomical contour which forms a chair shape for supporting an invalid in a seated position in the bathtub, said bathtub having a lateral opening in one of said sidewalls with sufficient size to permit ingress and egress therethrough;

a door selectively closing said bathtub opening;

a plurality of nozzles mounted on the sidewalls of said bathtub, and being spaced apart and mutually oriented to cover the seated invalid;

at least one of said nozzles being mounted in said door; and means for communicating said one nozzle with a source of pressurized water when said door is in a closed position, comprising:

a first fitting connected with said bathtub, and communicating with one of said one nozzle and said source of pressurized water; and a second fitting shaped for mating engagement with said first fitting, and communicating with the other of said one nozzle and said source of pressurized water; said second fitting being mounted on said door and translating therewith, and being positioned in alignment with said first fitting in the closed door position;

means for converging said first and second fittings into sealing engagement during the closed door position to selectively communicate said source of pressurized water with said one nozzle.

2. A bathing apparatus as set forth in claim 1, wherein:

said bathtub side and end walls have upper edges which define a bathtub rim; and said nozzles are positioned slightly below said rim, and are oriented generally downwardly toward said seat and foot portions of said bathtub.

3. A bathing apparatus as set forth in claim 2, wherein:

said nozzles have an orifice shaped to emit a fine, cone-shaped spray, and collectively create a gentle, blanket-like mist.

4. A bathing apparatus as set forth in claim 3, wherein:

each of said bathtub sidewalls includes four nozzles.

5. A bathing apparatus as set forth in claim 4, wherein:

said nozzles each have a spray pattern angle in the range of 50 to 60 degrees.

6. A bathing apparatus as set forth in claim 5, wherein:

said nozzles each have a spray pattern range of greater than one-half of the bathtub width, whereby the spray patterns overlap at the center of said bathtub.

7. A bathing apparatus as set forth in claim 6, including:

a spray nozzle mounted adjacent a rearward one of the bathtub end walls, and having a fan-shaped spray pattern which is oriented to flow a thin film of water along said rearward end wall to cushion and bathe the back and bottom of the seated invalid.

8. A bathing apparatus as set forth in claim 7, wherein:

said second-named, rearward nozzle has a spray pattern angle in the range of 100 to 140 degrees.

9. A bathing apparatus as set forth in claim 1, wherein:

said nozzles have an orifice shaped to emit a fine, cone-shaped spray, and collectively create a gentle, blanket-like mist.

10. A bathing apparatus as set forth in claim 1, including:

a spray nozzle mounted adjacent a rearward one of the bathtub end walls, and having a fan-shaped spray pattern which is oriented to flow a thin film of water along said rearward end wall to cushion and bathe the back and bottom of the seated invalid.

11. A bathing apparatus as set forth in claim 1, including:

means for forming a seal between said door and said bathtub when said door is in the closed position which is leakproof when said bathtub is filled with water to a level substantially above a base portion of said opening for immersal bathing of the seated invalid.

12. A bathing apparatus as set forth in claim 11, including:

means for vertically translating said door between an open position and a closed position.

13. A bathing apparatus as set forth in claim 12, wherein:

said door includes a latch having locked and unlocked positions;

means for automatically activating said fitting converging means, when said latch is shifted to the locked position.

14. A bathing apparatus as set forth in claim 13, wherein:

one of said first and second fittings includes a central orifice and a protruding rim with a closed margin; and the other of said first and second fittings includes a central orifice, and a compression pad which abuts said rim in the closed door position, and forms a watertight seal therebetween.

15. A bathing apparatus as set forth in claim 14, including:

means for resiliently urging said rim and pad together during the closed, locked door position.

16. A bathing apparatus as set forth in claim 15, wherein:

said one of said first and second fittings comprises a plunger slidably mounted for reciprocation in one of said door and said bathtub.

17. A bathing apparatus as set forth in claim 16, wherein:

said bathtub includes an upwardly opening lip in which a lower edge of said door is received; and said first fitting is mounted in said lip, and said second fitting is mounted in said door lower edge.

18. A bathing apparatus as set forth in claim 17, wherein:

a plurality of said nozzles are mounted on said door; and said door-mounted nozzles communicate with said source of pressurized water through a manifold disposed within said door.

19. A bathing apparatus as set forth in claim 18, including:

a spray nozzle mounted adjacent a rearward one of the bathtub end walls, and having a fan-shaped spray pattern which is oriented to flow a thin film of water along said rearward end wall to cushion and bathe the back and bottom of the seated invalid.

20. A bathing apparatus for invalids and the like, comprising:

an enclosure having a lateral opening in one side thereof with sufficient size to permit ingress and egress therethrough;

a door selectively closing said enclosure opening;

means for vertically translating said door between an open position and a closed position;

at least one spray nozzle connected with said door, and oriented to direct a spray of water into said enclosure; and means for communicating said nozzle with a source of pressurized water when said door is in said closed position, and comprising a first fitting connected with said enclosure, and communicating with one of said nozzle and said source of pressurized water; and a second fitting shaped for mating engagement with said first fitting, and communicating with the other of said nozzle and said source of pressurized water; said second fitting being mounted on said door and translating therewith, and being positioned in alignment with said first fitting during the closed door position.

21. A bathing apparatus as set forth in claim 20, wherein:

said enclosure includes an upwardly opening lip defining said opening in which a lower edge of said door is received; and said first fitting is mounted in said lip, and said second fitting is mounted in said door lower edge, whereby closing said door automatically converges said first and second fittings into sealing engagement.

22. A bathing apparatus as set forth in claim 21, wherein:

one of said first and second fittings includes a central orifice and a protruding rim with a closed margin; and the other of said first and second fittings includes a central orifice, and a compression pad which abuts said rim in the closed door position, and forms a watertight seal therebetween.

23. A bathing apparatus as set forth in claim 22, wherein:

said one of said first and second fittings comprises a plunger slidably mounted for reciprocation in one of said door and said enclosure.

24. A bathing apparatus as set forth in claim 23, including:

means for locking and unlocking said door in the closed position; and means for automatically reciprocating said plunger when said door is locked.

25. A bathing apparatus as set forth in claim 24, wherein:

said locking means is mounted in said door, and includes a manually pivoted locking arm; and said activating means includes a cable having one end connected with said locking arm, and the other end connected with said plunger, whereby pivoting said locking arm between locked and unlocked positions shifts said first and second fittings into and out of sealing engagement.

26. A bathing apparatus as set forth in claim 25, including:

means for resiliently urging said rim and pad together when said door is locked.

27. A bathing apparatus as set forth in claim 26, wherein:

said first fitting is slidably mounted in said door, and includes said plunger;

said second fitting is mounted on said enclosure, and includes said pad.

28. A bathing apparatus as set forth in claim 20, wherein:

said enclosure includes a bathtub with said opening disposed in one side thereof.

29. A bathing apparatus as set forth in claim 28, wherein:

said bathtub opening is defined by a lip having a generally wedge-shaped contour which opens upwardly;

said door has a sealing edge with a generally wedge shape which conforms with the contour of said lip;

a compression seal connected with one of said lip and said door sealing edge, whereby said door sealing edge and said bathtub lip are converged in the closed door position to compress said seal therebetween and form a seal therebetween which is watertight when said bathtub is filled with water to a level substantially above a base portion of said lip for immersal bathing.

30. A bathing apparatus as set forth in claim 20, wherein:

said enclosure includes a bathtub having said opening in one side thereof, and including means for forming a seal between said door and said bathtub when said door is in said closed position which is leakproof when said bathtub is filled with water to a level substantially above a base portion of said opening for immersal bathing; and including a pair of tracks supported on opposing sides of said door, and extending vertically upwardly above said bathtub and rearwardly thereof over said bathtub; and means for slidably mounting said door on said tracks and vertically translating said door upwardly from the closed position, and rotating said door as it is raised into a substantially horizontal, overhead storage position directly over said bathtub.

31. A bathing apparatus as set forth in claim 20, wherein:

said enclosure includes a bathtub having a raised seat portion, a back portion extending generally upwardly from said seat portion, and a foot portion disposed below and forwardly of said seat portion; said seat, back and foot portions having an anatomical contour which forms a chair shape for supporting an invalid in a seated position in the bathtub; said lateral opening being disposed in one side of said bathtub and being oriented substantially parallel with the sides of said seat portion; and including means for forming a seal between said door and said bathtub when said door is in said closed position which is watertight when said bathtub is filled with water to a level substantially above a base portion of said opening for immersal bathing of an invalid, whereby said unit is capable of both immersal bathing and showering the invalid for hygiene and therapy.

32. A bathing apparatus as set forth in claim 20, wherein:

said enclosure includes a bathtub having a seat portion disposed at an elevation substantially commensurate with the seat of a conventional wheelchair, a back portion extending generally upwardly from said seat portion, and a foot portion disposed below and forwardly of said seat portion; said seat, back and foot portions having an anatomical contour which forms a chair shape for supporting an invalid in a seated position in said bathtub; said bathtub having opposed sides which extend upwardly from said seat and foot portions and form a closed reservoir for partially immersing the seated invalid; one of said bathtub sides being bodily removable from said bathtub to define said opening which comprises the outer side edge of said seat, back and foot portions; and including means for forming a seal between said door and said bathtub when said door is in said closed position which is watertight when said bathtub is filled with water to a level substantially above the outer edge of said foot portion for immersal bathing of the invalid; and said door translating means removes said door to an elevated position above said bathtub to fully access said opening, whereby when a wheelchair is parked parallel with said bathtub, beside the seat portion thereof, an attendant can laterally shift a patient from the wheelchair onto the bathtub seat portion by translating the patient along a slightly arcuate, substantially horizontal path with a natural, unstrained motion, which permits the attendant to keep his feet fixed on the floor, and maintain the weight of the invalid close to his body.

33. A bathing apparatus as set forth in claim 1, wherein:

said door includes a latch having locked and unlocked positions;

means for automatically activating said communicating means when said latch is shifted to the locked position.

* * * * *